US005680833A

United States Patent [19]

Smith

[11] Patent Number: 5,680,833

[45] Date of Patent: Oct. 28, 1997

[54] COMBINATION COOLANT DEAERATION AND OVERFLOW BOTTLE

[75] Inventor: Gary M. Smith, Waterford, Mich.

[73] Assignee: Chrysler Corporation, Auburn Hills, Mich.

[21] Appl. No.: 771,993

[22] Filed: Dec. 23, 1996

[51] Int. Cl.[6] ..... F01P 11/02

[52] U.S. Cl. ..... 123/41.54; 165/104.32

[58] Field of Search ..... 123/41.54; 165/104.32

[56] References Cited

U.S. PATENT DOCUMENTS

| | | | |
|---|---|---|---|
| 3,775,947 | 12/1973 | Dupont et al. | 55/159 |
| 4,130,159 | 12/1978 | Ohta et al. | 165/111 |
| 4,723,596 | 2/1988 | Spindelboeck et al. | 165/104.32 |
| 4,739,730 | 4/1988 | Jenz et al. | 123/41.54 |
| 5,111,776 | 5/1992 | Matsushiro et al. | 123/41.54 |
| 5,329,889 | 7/1994 | Caldwell | 123/41.54 |
| 5,456,218 | 10/1995 | Theorell | 123/41.54 |

*Primary Examiner*—Noah P. Kamen

*Attorney, Agent, or Firm*—Kenneth H. MacLean

[57] ABSTRACT

A multi-chambered liquid coolant receiving bottle unitized from upper and lower plastic parts forming part of the closed coolant system of an internal combustion engine. When unitized the bottle comprises a pressurized coolant deaeration chamber separated by a convexly curved stationary pressure wall from overflow chamber. The chambers are arranged laterally side-by-side and are hydraulically connected to one another by a hose external of the bottle. The upper plastic part forming an upper portion of the coolant chamber supports a coolant filler neck that operatively mounts a pressure cap thereon. The pressure cap has a lower primary seal, an upper secondary seal and a vacuum breaker valve and cooperates with the filler neck so that coolant is transmitted to the overflow chamber from the deaeration chamber when the coolant of the system expands and from the overflow chamber to the dearation chamber when the system coolant contacts and creates a vacuum.

7 Claims, 6 Drawing Sheets

COMBINATION COOLANT DEAERATION AND OVERFLOW BOTTLE

FIELD OF THE INVENTION

This invention relates to liquid cooling systems for internal combustion engines and, more particularly, to a new and improved multi-chamber coolant deaeration and overflow bottle for engine cooling systems.

BACKGROUND OF THE INVENTION

Prior to the present invention various vehicle engine cooling systems have employed a wide range of components for improving engine cooling operations to enhance engine service life and performance. Among components utilized in liquid cooling systems are pressurized deaeration or degassing bottles that are coupled directly into the cooling system to remove air and other gases in suspension in the liquid coolant to improve coolant efficiency in transferring heat energy from the engine block and head, and subsequently, from the coolant to the radiator and heater cores.

In addition to such deaeration or degasser bottles, separate overflow bottles have also been employed to catch engine coolant pushed out of the cooling system from engine overheating or system overfill. Such overflow bottles are connected to the system by a valve controlled connector line that routes the overflow from the deaeration bottle to the overflow bottle and to return the collected cooling fluid to the deaeration bottle and the engine coolant system as it cools down.

While the majority of current vehicles have either a deaeration bottle or a common overflow bottle, some vehicles utilize both and others employ a combination. For example, in U.S. Pat. No. 4,723,596, issued Feb. 9, 1988, for "EXPANSION, DEAERATION AND RESERVOIR TANK FOR THE LIQUID COOLING SYSTEM OF AN INTERNAL COMBUSTION ENGINE", a combined volume expansion and deaeration tank for a liquid cooling system of an internal combustion engine is disclosed. In the above referenced patent, an overflow chamber at atmospheric pressure is provided directly above a pressurized deaeration chamber divided by a separate partition wall having sealing at two partition planes. This tank further has an internal overflow passage and a fill tube that extends through the overflow chamber down to the lower pressure chamber.

SUMMARY OF THE INVENTION

The present invention meets higher standards for a two part liquid vessel readily usable with a liquid cooling system of an internal combustion engine. The invention provides improved joining and sealing of separate chambers and features compartmentalized slow-flow coolant deaeration in one chamber operatively communicable with a high capacity overflow and reservoir chamber.

More particularly, the present invention is drawn to new and improved multi-chambered liquid coolant bottle for an engine cooling system which is joined at the common interface of two molded plastic parts to form discrete deaeration and overflow chambers laterally disposed side-by-side. This invention enhances sight observation of both chambers and access to the deaeration chamber for efficient filling of the cooling system and removal of the coolant therefrom for inspection or testing.

The invention further eliminates the fill tube and overflow constructions of units and provides the new and improved mounting for a pressure relief cap with coolant flow control valving mounted directly on a foreshortened fill tube secured to the pressurized deaeration chamber. The cap automatically releases pressure in the cooling system and allows automated cooling system filling equipment to attach to the bottle.

In the present invention, there is a primary pressure chamber for degassing in which coolant from the engine cooling system gradually flows during engine operation and allows a sufficient flow period for separation of the air and any other gasses suspended in the liquid coolant. In addition to the primary pressure chamber, there is a secondary and open chamber which is advantageously separated from the primary chamber by arced high pressure wall construction. These chambers are arranged so that no undue stresses are imparted to the sealed joint between the two plastic parts forming the bottle. A valved pressure cap mounted to a fill neck provided directly on the primary chamber responds to increased positive pressure changes in the system by opening to deliver coolant pushed out of the cooling system into the secondary chamber.

Additionally, the present invention provides an improved engine liquid cooling system structure with a unitized deaeration and overflow bottle and method of conducting coolant, steam or other gas, solely through a primary chamber in a slow and controlled manner for degassing purposes under normal engine operation conditions and then externally of the primary chamber to the secondary chamber when the coolant in the coolant system expands beyond a predetermined value, and subsequently to return the coolant from the secondary chamber to the primary chamber when the engine cooling system pressure or coolant volume falls to a predesignated value.

Another object, feature and advantage of this invention is to provide a new and improved multi-chambered liquid coolant receiving bottle unitized from upper and lower plastic parts for connection into the coolant system of an internal combustion engine. The formed bottle comprises a pressurized coolant deaeration chamber separated by a convexly curved stationary pressure wall from a discrete overflow chamber. The chambers are arranged side-by-side and are hydraulically connected to one another by a flow passage external of the bottle. The upper plastic part is formed with a liquid fill neck leading to the deaeration chamber on which a pressure cap is mounted. The pressure cap has a lower primary seal, an upper secondary seal and a vacuum breaker valve and cooperates with the cap seat in the fill neck so that coolant is transmitted to the overflow chamber from the pressurized chamber when the coolant of the system expands and from the overflow chamber to the pressure chamber when the system coolant contracts and creates a vacuum.

Another feature and object of this invention is to provide a new and improved engine liquid coolant bottle with discrete degassing and overflow chambers laterally disposed in a side-by-side relationship with one of the chambers being solely supported by the other.

Another feature, object and advantage is to provide a new and improved engine coolant bottle having upper and lower section of plastics material fused together at a fluid tight seam or interface to form side-by-side and laterally extending degassing and overflow chambers with direct connection to the engine cooling system and an external hose connection to one another.

These and other features, objects and advantages of the invention will be more apparent from the following description and drawing in which:

DETAILED DESCRIPTION OF THE PREFERRED EMBODIMENT

Figure 1:
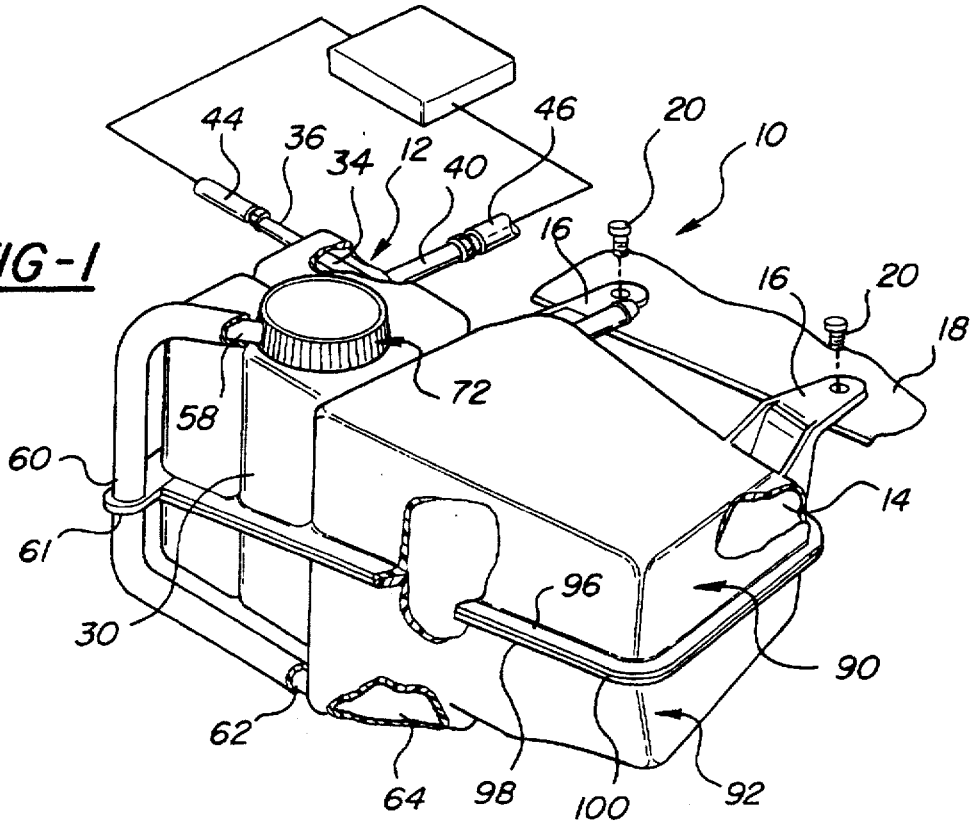
FIG. 1 is a pictorial view with parts broken away of a preferred embodiment of the combination deaeration and overflow bottle of the present invention.
Figure 3:
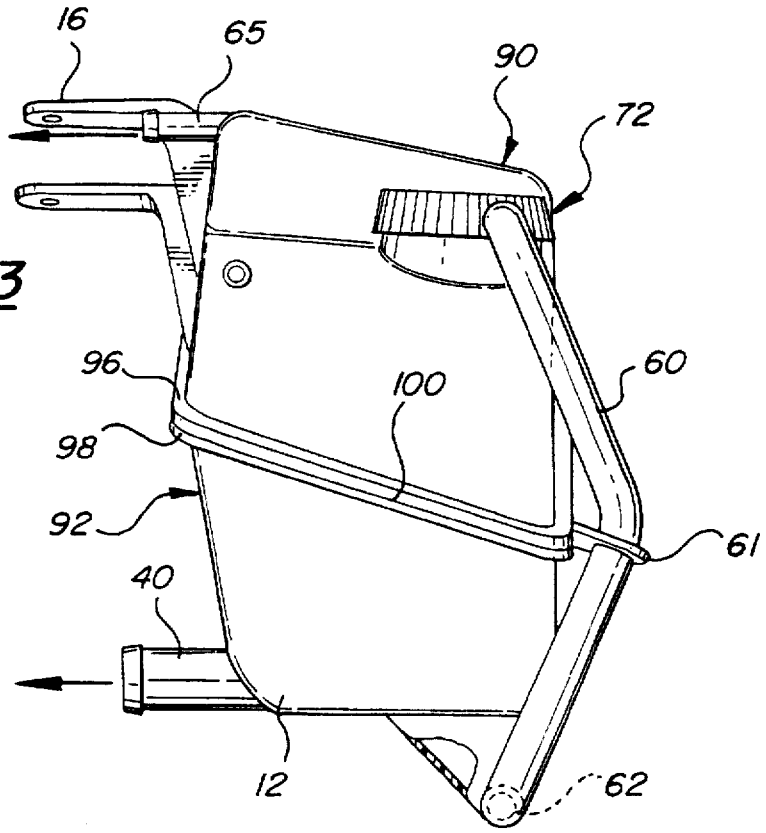
FIG. 3 is an end view of the bottle of FIG. 1 as viewed in the direction of sight line 3 of FIG. 2.

Turning now in greater detail to the drawings, there is shown in FIG. 1 a multi-part bottle 10 comprising a first part forming a liquid coolant deaeration or degasser chamber 12 and a second part forming a liquid coolant overflow chamber 14 advantageously joined in a side-by-side lateral relationship for operative connection with closed liquid cooling system for cooling the internal combustion engine of a wheeled vehicle.

The part of the bottle 10 forming the overflow chamber 14 has a pair of laterally-spaced mounting brackets 16 integral therewith for attachment with support structure 18 within the engine compartment of the vehicle by fasteners 20.

Figure 4:
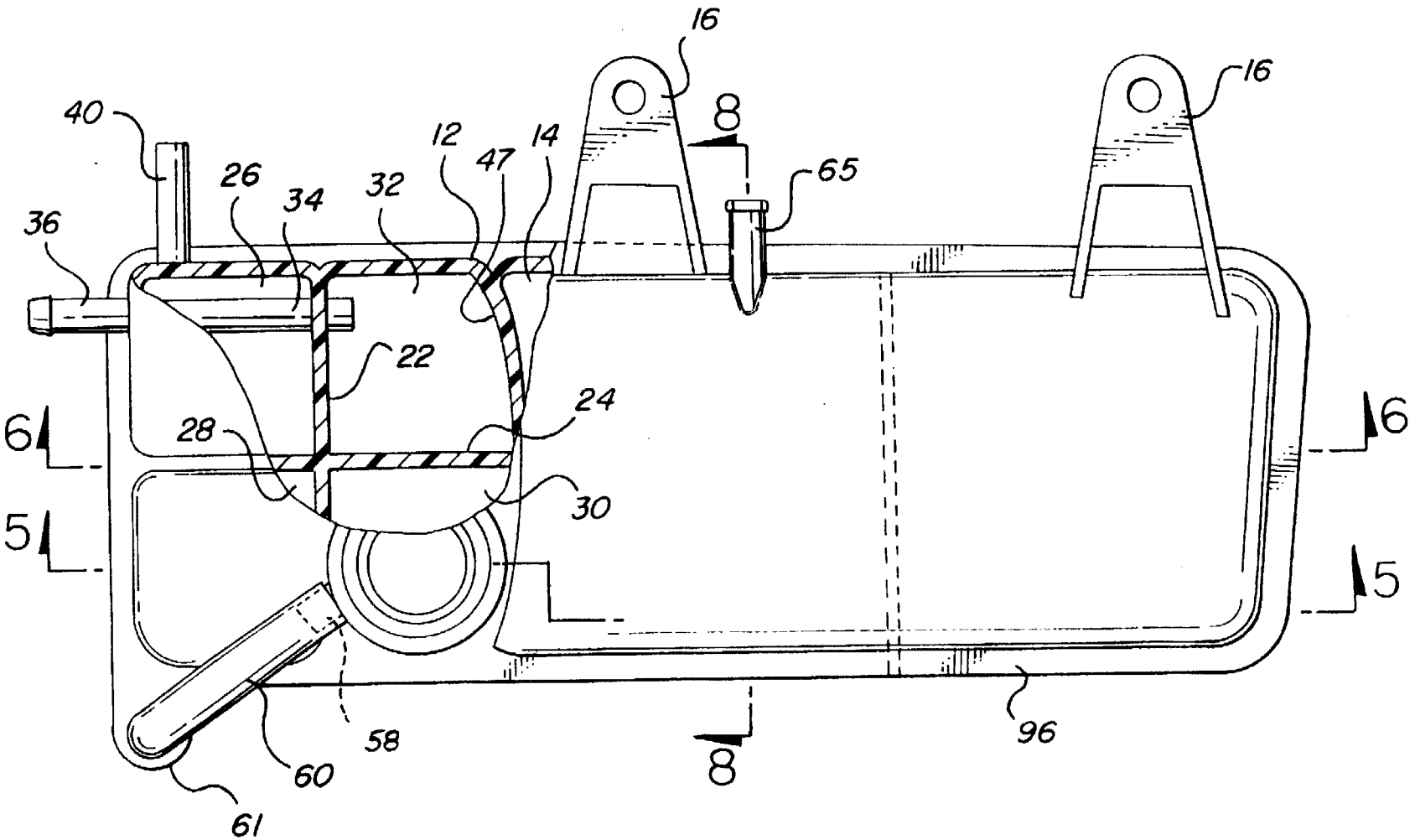
FIG. 4 is a top view of the bottle of FIGS. 1 through 3.

The degasser chamber 12 is strengthened and is subdivided by right angularly disposed partition walls 22, 24 into a plurality of compartments 26, 28, 30 and 32 that hydraulically communicate with one another to establish a low flow rate coolant flow path therethrough. A coolant inlet or nipple 36 is formed on the first part of the bottle 10 that operatively connects to a tubular extension 34 that communicates with a first compartment 32. A coolant outlet 40 is provided for the degasser chamber which is hydraulically connected to a fourth compartment 26. The inlet and outlets are connected by suitable hoses 44 and 46 to the liquid cooling system of the vehicle engine. The degasser chamber accordingly forms an integral part of the full time flow circuit of the closed cooling system of the engine. The interior wall 47 of the pressurized degasser chamber is convexly arced as shown best in FIG. 4 to provide a strengthened pressure vessel.

Figure 5:
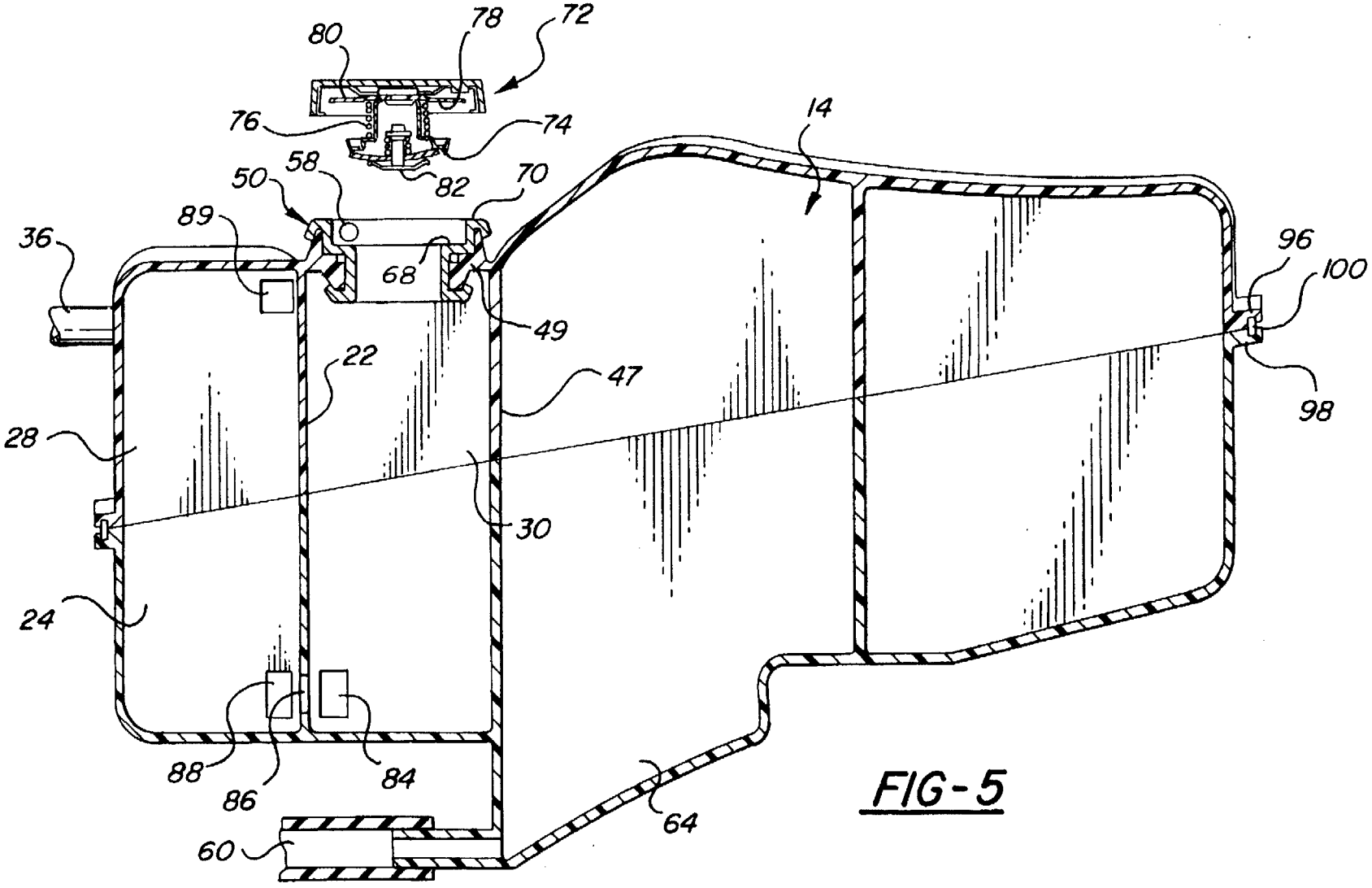
FIGS. 5 and 6 are sectional views taken along sight lines 5—5 and 6—6 of FIG. 4.
Figure 6:
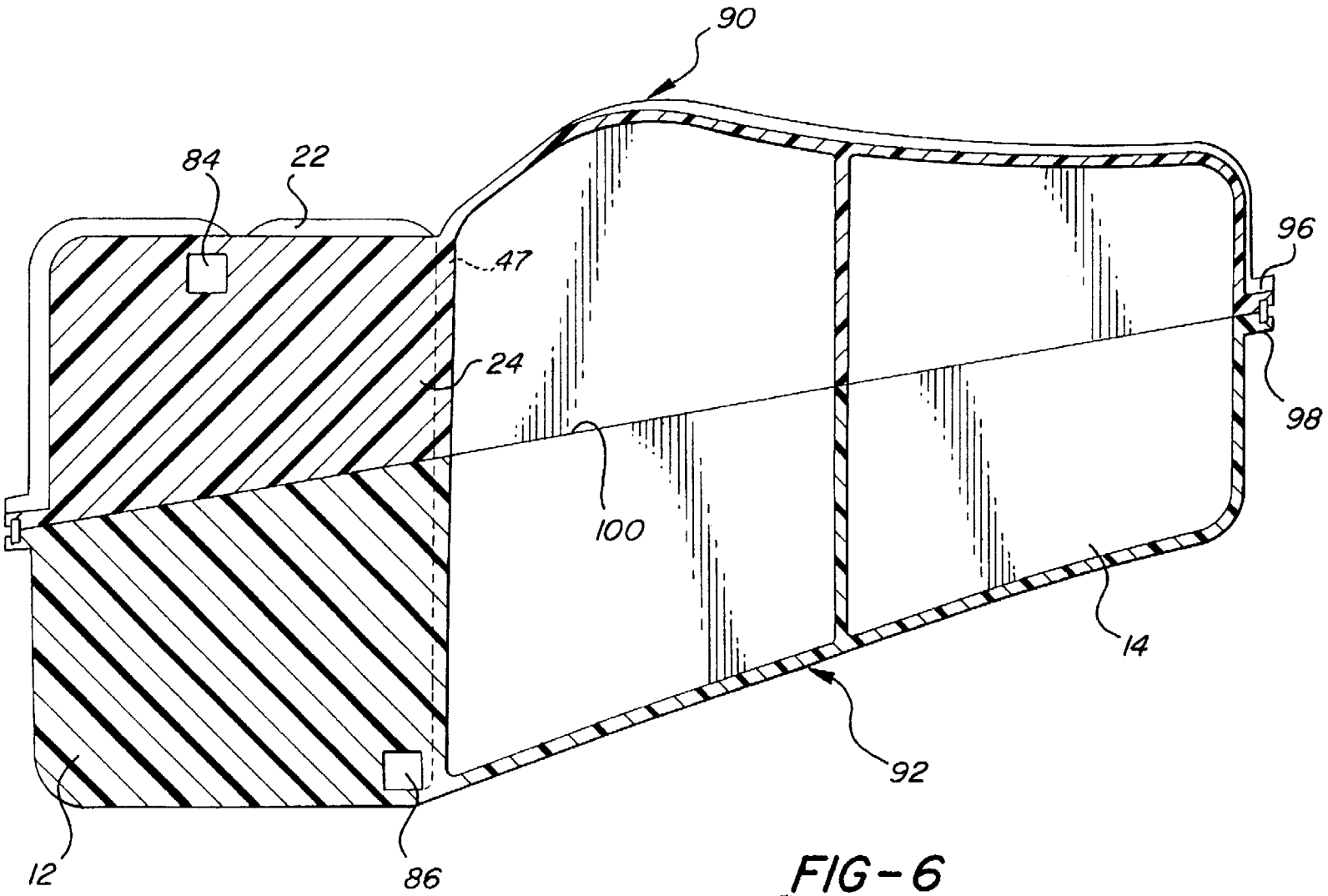
Figure 7:
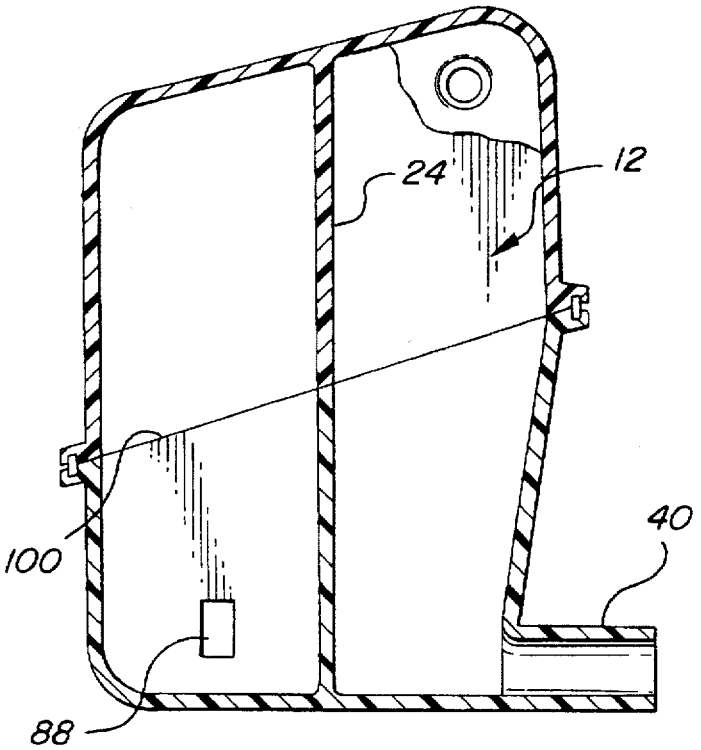
FIG. 7 is a view of the gassing portion of the bottle of FIGS. 1–6 taken along line 7 of FIG. 2.
Figure 8:
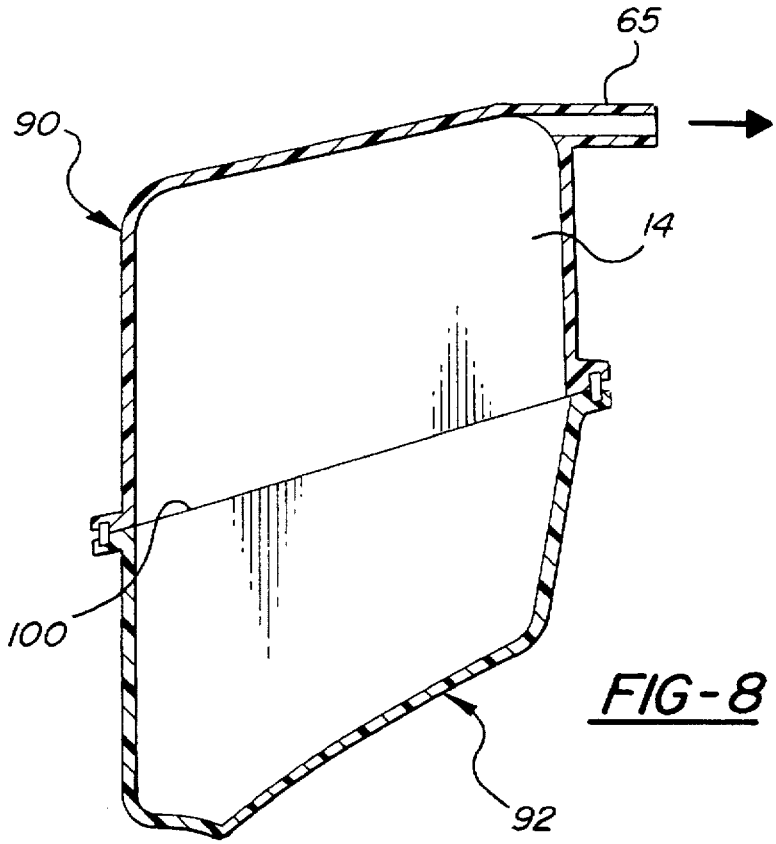
FIG. 8 is a sectional view taken along lines 8—8 of FIG. 4.

The part of the bottle 10 that forms degasser chamber 12 has an upper socket 49 through the upper wall thereof that mounts a tubular metal filler neck 50, such as shown best in FIG. 5, that leads directly into the compartment 30 of the degasser chamber, this provides direct and convenient access for the supply of coolant into the cooling system of the vehicle engine.

Figure 2:
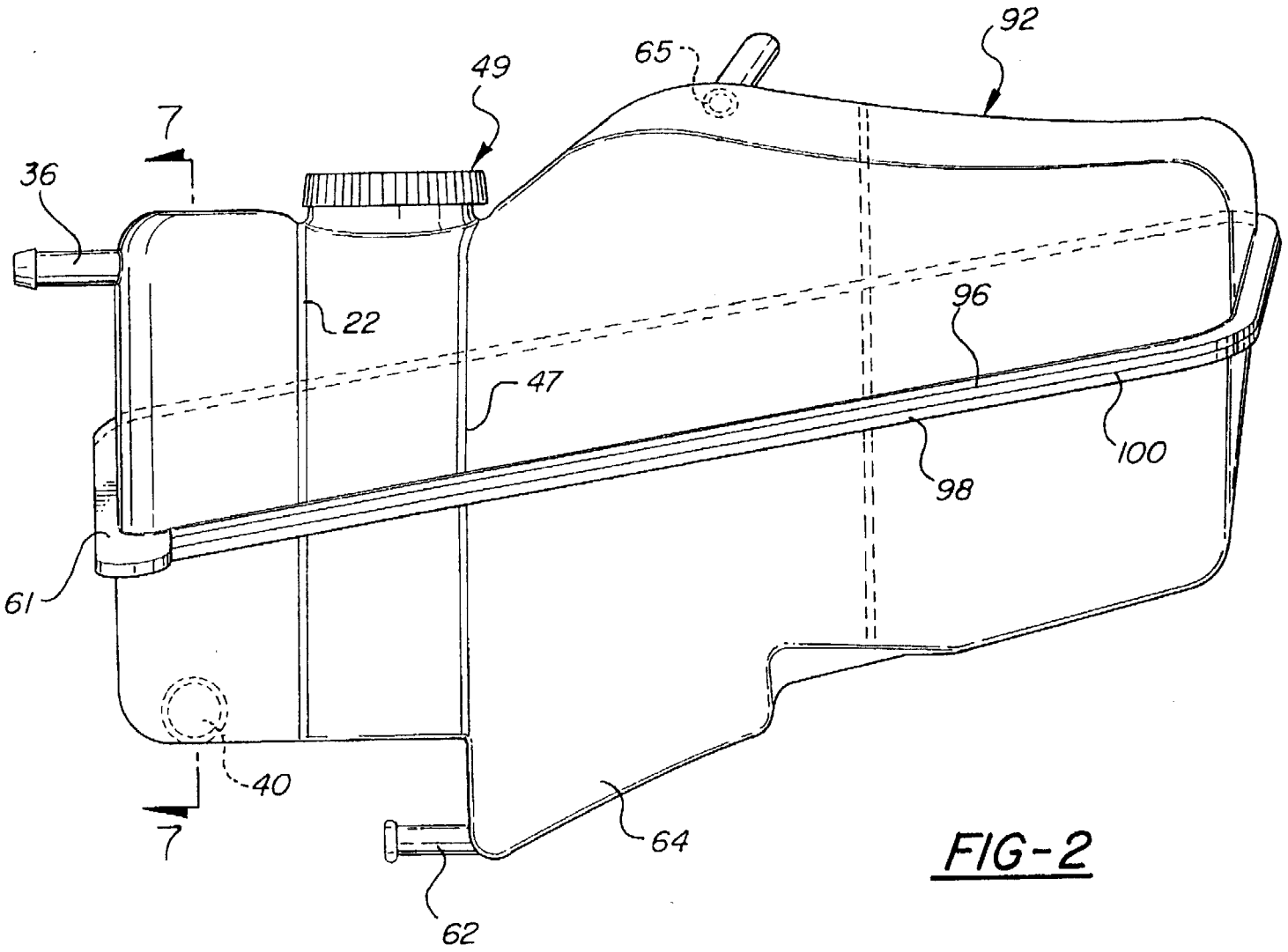
FIG. 2 is a side view of the deaeration and overflow bottle of FIG. 1.

An overflow outlet 58 is connected into the filler neck and accommodates a coolant conducting tube 60 routed externally of the bottle through a circular opening in an outwardly extending plastic support part 61 of the bottle to an overflow inlet-outlet nipple 62 leading into the overflow section 14 of the bottle 10. A shown best in FIGS. 1, 2 and 5, this connection is into a lowermost and inclined recess portion 64 of the overflow chamber 14 arranged so that substantially all of the coolant in the overflow chamber 14 flows therethrough and is available for return back into the coolant system under operating conditions described below. The overflow chamber 14 has an exhaust opening or optionally a nipple 65 to exhaust coolant therefrom when filled to capacity.

The interior of the filler neck 50 has a lower primary annular sealing seat 68 and an upper secondary annular sealing seat 70 formed thereon for receiving associated seals of a conventional pressure cap 72. When in an installed position on the neck 50, the cap 72 maintains pressure in the cooling system so that the engine can run at desirable higher temperatures without boiling the coolant.

The pressure cap 72 has an annular primary seal 74 which is yieldably held by main spring 76 onto the lower sealing seat 68, and an upper secondary seal 78 that is held onto the secondary seat 70 by a spring washer 80.

In addition to the upper and lower seals, the pressure cap has a vacuum or vent valve 82 centrally mounted with respect to the pressure seal for vacuum relief of the system when the engine cools and the coolant contracts to establish a vacuum in the system.

In the event the coolant heats to a point where the pressure from expanding coolant causes the primary seal 74 of the cap to lift from its seat 68, the coolant can overflow from the degasser chamber via the filler neck, with the upper seal 78 remaining closed, and route through the overflow tube 60 to the overflow chamber 14. When the coolant within the cooling system contracts to a point sufficient to establish a vacuum, the vent valve 82 will open so that the coolant will flow from the reservoir chamber 14 via the lower recess 64 back into the degasser chamber 14 and thus into coolant system. With the inclination provided by lower recess section 14 leading to the nipple 62, substantially all of the coolant in the overflow chamber is available for return into the cooling system of the engine.

In normal engine operation, the coolant flows slowly and serially through the compartments of degassing chamber 12 passing through the windows such as windows 84, 86, 88 and 89 provided in the partition walls 22, 24. After degassing, the coolant routes back to the engine.

In the preferred embodiment the bottle 10 is translucent so that the coolant in the pressurized degasser and overflow chambers is readily observable. The bottle is preferably formed from polypropylene copolymer and is unitized from two halves comprising an upper half 90 and a lower half 92 which are separate injection moldings. The upper molded half 90 comprises the upper portion of the degasser chamber 12 and the upper portion of the overflow chamber 14. The lower half of the bottle comprises the lower portion of the degasser chamber 12 and the lower portion of the overflow chamber 14. As shown, the two halves 90, 92 are formed with enlarged peripheral flanges 96, 98, respectively, and these halves are heated and then pressed together under light load to the point where the flanges fuse together and form the horizontal seam which provides a high pressure seal 100 between the upper and lower halves 90, 92. Similar joining and sealing is formed in the partition walls and wall 47 between the degasser chamber 12 and the overflow chamber 14.

Accordingly, with this arrangement, the degasser chamber which may expand and contract in pressure operation does not overly stress any sealed joint or area so that sealing between the two chambers has long service life.

In the preferred embodiment the plastics material used for the bottle is translucent so one can readily observe coolant in the overflow and degasser chambers without opening the cap. In the event that a single volume is desired in the deaeration or degasser section, the partition walls 22, 24 may be eliminated and all of the exterior walls thereof suitably modified to provide a high strength pressure vessel.

While a preferred embodiment of the invention has been shown and described, other embodiments will now become apparent to those skilled in the art. Accordingly, this invention is not to be limited to that which is shown and described but by the following claims.

I claim:

1. A combined deaeration and overflow bottle for receiving liquid coolant from the cooling system of an internal combustion engine comprising an upper half and a lower half of plastic materials adapted to be directly joined together into a unit with discrete sections for the coolant, a first of said sections defining a pressurizable degassing chamber for directly receiving liquid coolant from the cooling system of the engine, a second of said sections providing an overflow chamber, an external passageway extending outside of said bottle and interconnecting said chambers for conducting coolant fluid in from said degassing chamber to said overflow chamber when said liquid coolant of said cooling system expands and for conducting coolant from said overflow chamber to said degassing chamber when the liquid coolant in said system contracts in volume sufficient to establish a vacuum in said cooling system.

2. The bottle of claim 1, wherein said sections are separate from one another and are laterally disposed side-by-side with respect to one another.

3. The bottle of claim 2, wherein a convexly curved pressure wall forms a side wall separating said degassing chamber and said overflow chamber.

4. The bottle of claim 2, wherein said external passageway is a flow tube and said overflow chamber has a discrete and lowermost recess portion and said recess portion has coolant inlet-outlet nipple operatively connected to said flow tube.

5. A combination deaeration and overflow bottle for receiving the liquid coolant of a liquid cooling system of an internal combustion engine comprising an upper and lower halves of plastic materials directly joined together to form discrete first and second sections, a first of said sections having a plurality of internal partition walls therein to define a pressurizable degassing chamber for directly receiving the liquid coolant from the cooling system of the engine, a second of said sections providing a coolant overflow chamber, a coolant filler neck on said first section providing an access to said degasser chamber and a passageway extending outside of said bottle which conducts fluid from said pressurizable degassing chamber, said filler neck to said overflow chamber when said liquid coolant of said system expands and which conducts fluid from the overflow chamber to the chamber section by way of the filler neck when said liquid coolant in said degasser chamber contracts in volume to establish a vacuum in said system.

6. The container of claim 5, wherein said chambers are separated from one another by a common pressure wall and are laterally disposed side-by-side with respect to one another.

7. The container of claim 6, said pressure wall is convexly curved with respect to the contour of said degassing section.

* * * * *